United States Patent [19]

Dutt et al.

[11] Patent Number: 4,930,647

[45] Date of Patent: Jun. 5, 1990

[54] TAMPER INDICATING CLOSURE SYSTEM UTILIZING AXIALLY EXTENDING RATCHET

[75] Inventors: Herbert V. Dutt, Sarasota, Fla.; Duane H. Lewis, Claysville, Pa.

[73] Assignee: Continental Plastics, Inc., Triadelphia, W. Va.

[21] Appl. No.: 301,239

[22] Filed: Jan. 24, 1989

[51] Int. Cl.[5] ..... B65D 41/34

[52] U.S. Cl. ..... 215/252; 215/256; 215/330; 215/336; 215/337

[58] Field of Search ..... 215/250, 252, 256, 258, 215/330, 335, 336, 337; 220/276, 301, 302

[56] References Cited

U.S. PATENT DOCUMENTS

| | | | |
|---|---|---|---|
| 2,153,426 | 4/1939 | McNamaro et al. | 215/7 |
| 2,423,582 | 7/1947 | Coleman | 215/252 |
| 2,980,275 | 4/1961 | Lundgren | 215/330 |
| 3,405,831 | 10/1968 | Hudson | 215/330 |
| 3,874,540 | 4/1975 | Hidding | 215/252 |
| 3,901,403 | 8/1975 | Menke | 215/258 X |
| 3,977,557 | 8/1976 | Hazard | 215/330 X |
| 4,081,097 | 3/1978 | Dold | 215/252 |
| 4,352,436 | 10/1982 | Chartier et al. | 215/252 |
| 4,423,820 | 1/1984 | Vanger | 215/252 |
| 4,461,391 | 7/1984 | Davis | 215/252 |
| 4,501,373 | 2/1985 | Heinlein | 215/252 |
| 4,503,986 | 3/1985 | Nixdorff et al. | 215/252 |
| 4,529,094 | 7/1985 | Chartier et al. | 215/252 |
| 4,534,480 | 8/1985 | Santostasi et al. | 215/252 |
| 4,550,843 | 11/1985 | Nolan | 215/252 |
| 4,560,076 | 12/1985 | Boik | 215/252 |
| 4,749,094 | 6/1988 | Fuchs | 215/252 |
| 4,828,127 | 5/1989 | Young et al. | 215/252 |

FOREIGN PATENT DOCUMENTS

| | | | |
|---|---|---|---|
| 963845 | 3/1975 | Canada | 215/330 |
| 8190 | 2/1980 | European Pat. Off. | 215/252 |
| 3018447 | 11/1981 | Fed. Rep. of Germany | 215/252 |
| 1536459 | 7/1968 | France . | |
| 2191178 | 12/1987 | United Kingdom | 215/256 |

*Primary Examiner*—Stephen Marcus
*Assistant Examiner*—Christine A. Peterson
*Attorney, Agent, or Firm*—Richard V. Westerhoff

[57] ABSTRACT

A thermoplastic closure comprises an annular tamper band connected to the skirt of a cap by frangible bridges. In one embodiment of the closure, axially extending ratchet teeth on the bottom of the tamper band cooperate with axially extending lugs on a container shoulder or transfer bead. As the cap is screwed onto the container, the teeth ratchet over the lugs. When an attempt is made to unscrew the cap, the ratchet teeth engage the lugs to prevent rotation of the tamper band so that continued application of an unscrewing force to the cap results in fracturing of the bridges along the intersection of reduced cross-section between the bridges and the skirt. The axial length of the engaging surfaces of the ratchet teeth and lugs is sufficient that they remain axially aligned through any initial axial separation of the cap and transfer bead until the ratchet teeth and lugs engage. In another embodiment of the closure, axially extending projections on the tamper bead are bent circumferentially by the lugs on the container as the closure is screwed onto the container. The bent projections wedge against the lugs as the cap is unscrewed to prevent rotation of the tamper band with the cap resulting in fracturing of the bridges.

25 Claims, 3 Drawing Sheets

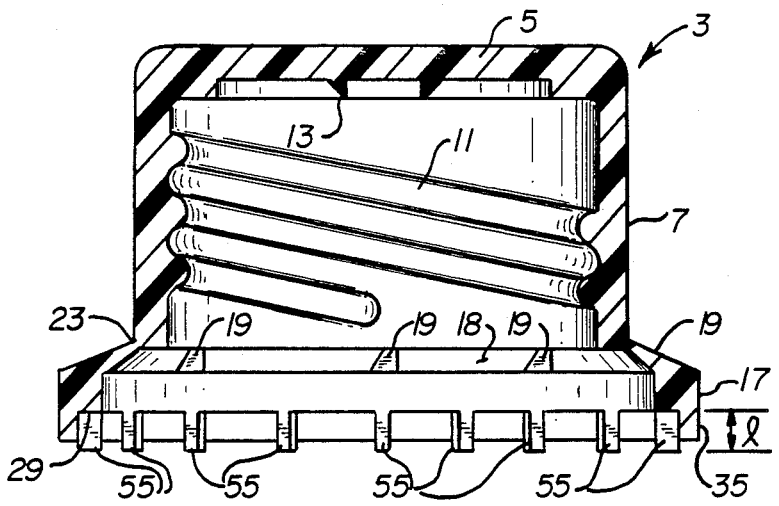
FIG. 5
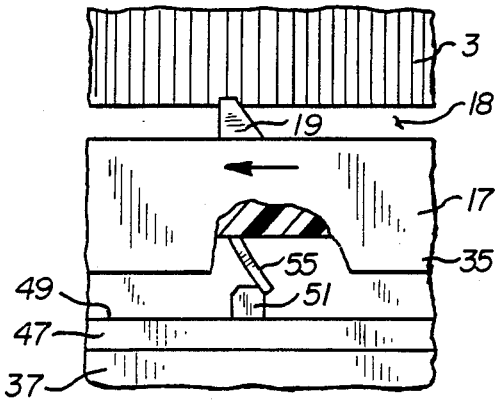
FIG. 6
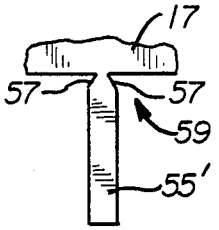
FIG. 8
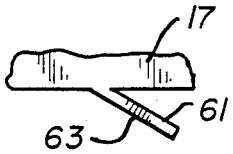
FIG. 9
FIG. 7
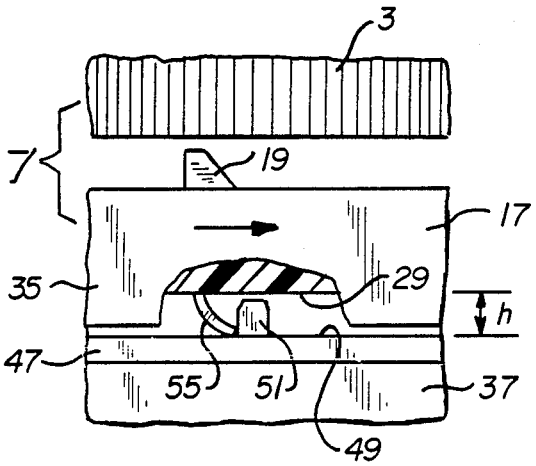

TAMPER INDICATING CLOSURE SYSTEM UTILIZING AXIALLY EXTENDING RATCHET

BACKGROUND OF INVENTION

1. Field of the Invention

This invention relates to a closure system including a closure having an integral tamper band connected to the skirt of the closure by bridges which fracture upon removal of the closure to provide a visual indication that the container has been opened or tampered with. More particularly, the invention relates to such a closure system in which axially extending ratchet members on the end of the tamper band and on the container cooperate to allow the tamper band to rotate with the closure as the closure is screwed onto the container, but prevent rotation of the tamper band as the closure is unscrewed to fracture the bridges joining the tamper band to the closure skirt.

2. Background Information

It is common practice today for container closures to have tamper indicating means which provide a visual and mechanical indication that the container has been opened or tampered with. Many of these tamper indicating closures include a tamper band secured to the skirt of the cap by frangible bridges which fracture when an attempt is made to remove the cap. When such tamper bands are applied to screw type closures, it is common to provide means to prevent rotation of the tamper band relative to the cap as the cap is unscrewed. Typically, this means has been radially extending ratchet members on the container neck and on the inner surface of the annular tamper band. Examples of such closures are found for example in U.S. Pat. Nos. 3,874,540 and 4,534,480. Such closures require very close tolerances on the closure and the container to assure proper engagement of the ratchets.

Many tamper bands are secured to the container by a radially inwardly directed lip which engages a radial flange or transfer bead on the container. Some of these tamper bands are provided with ratchet teeth which cooperate with corresponding members on the skirt to couple the tamper band to the cap during application of the closure to the container to resist premature fracturing of the bridges as the lip on the tamper band is forced over the transfer bead. When the cap is unscrewed, the inclined surfaces on the ratchet teeth cooperate to axially separate the tamper band from the skirt thereby applying an axial force to assist in fracturing the bridges. Closures with such features are disclosed, for example, in U.S. Pat. Nos. 4,461,391 and 4,560,076, and French patent no. 1,536,459. The closure in the second of these patents also utilizes radially extending ratchet teeth to prevent rotation of the tamper band as the cap is unscrewed. Such closures must also be made with close tolerances to preclude prying of the tamper band off of the transfer bead. Furthermore, the bridges must be made stronger to resist the twisting moment applied to them during application of the cap. This makes it more difficult to fracture the bridges on removal of the cap.

The closure disclosed in U.S. Pat. No. 4,503,986 has a tamper indicator made of a lower ring keyed to radial projections on the container to prevent rotation and joined to an upper ring of larger diameter by frangible bridges. Axially extending ratchet teeth on the upper ring cooperate with lugs on the cap skirt to permit relative rotation between the cap and the indicator as the cap is being screwed on, but lock the upper ring to the cap for rotation therewith during unscrewing of the cap to fracture the bridges. This closure requires both radial and axial engagement means for the tamper band and is more difficult and costly to manufacture. In addition, the tamper band is not integral with the cap, therefore requiring additional handling during application of the two piece closure to a container.

There remains a need for a reliable, inexpensive, easily manufactured closure with a tamper band which provides an indication that the closure has been opened or tampered with.

There is further need for such a closure which does not require tight tolerances either on the closure or the container to which the closure is applied.

There is also a need for such a closure in which bridges connecting the tamper band to the cap do not have to resist large forces during application of the cap so that they can be made to fracture with less force upon removal of the cap.

With regard to the need for such a closure which can be easily manufactured, the closure should be designed such that it can be integrally molded without the need for slides or other complex molding techniques.

SUMMARY OF THE INVENTION

These and other needs are satisfied by the invention which is directed to a closure system including a closure comprising a cap having an internally threaded skirt extending from an end wall. An annular tamper band extends axially beyond the free end of the cap skirt and is detachably joined thereto by circumferentially spaced frangible bridges between a first axial end of the tamper band and the skirt. Preferably, the inner diameter of the tamper band is greater than the outer diameter of the cap skirt, and the frangible bridges taper axially and radially from the tamper band to the free end of the skirt to provide an area of smallest cross-section at the intersection with the skirt. Also preferably, the bridges are notched in the direction of rotation for removal of the cap from the container to further reduce the cross section of the bridges at their intersection with the skirt.

Cooperating ratchet members on the second end of the tamper band, and on a generally laterally extending surface of a container to which the closure is applied, extend axially toward one another. These ratchet members define substantially axially extending engagement surfaces which, when engaged, prevent rotation of the tamper band with the skirt as the closure is rotated to unscrew the closure from the container neck. This results in fracturing of the frangible bridges and separation of the tamper band from the skirt. The engagement surfaces on the cooperating ratchet members are of sufficient axial length that they remain axially aligned for engagement throughout any initial axial movement of the tamper band with the skirt as the closure is unscrewed prior to fracture of the bridges.

In one embodiment of the invention, at least one of the cooperating ratchet members comprises a plurality of circumferentially spaced ratchet teeth, each defining a substantially axially extending engagement surface and an axially and circumferentially extending camming surface over which the other cooperating ratchet member rides as the closure is screwed onto the container. Preferably, the plurality of ratchet teeth are provided on the second end of the tamper band and the other cooperating ratchet member on the container comprises a number of circumferentially spaced, axially extending lugs each of which defines a substantially axially extending engagement surface.

In accordance with another embodiment of the invention, one of the cooperating ratchet members comprises a plurality of axially extending projections which are bent in a circumferential direction through contact with the other cooperating ratchet member, which is preferably a number of lugs, as the cap is screwed onto the container. The bent projections become wedged against the lugs and are placed in compression to resist rotation of the tamper band with the cap as the latter is unscrewed, resulting in fracture of the bridges. The projections may be hinged to their support and made thicker to resist the compression forces. Alternatively, the projections can be formed so that they extend axially and circumferentially in a direction forming a camming surface which cams over the lugs as the cap is screwed onto the container, again with the projections wedging against the lugs during unscrewing of the cap to prevent rotation of the tamper band with the cap. Preferably, the projections are provided on the tamper band of the closure and the lugs are provided on the container.

The invention includes both the closure and the closure in combination with the container having axially extending cooperating ratchet members.

BRIEF DESCRIPTION OF THE DRAWINGS

A full understanding of the invention can be gained from the following description of the preferred embodiment when read in conjunction with the accompanying drawings in which:

FIG. 5 is a vertical section through another embodiment of the invention.

FIG. 6 is a fragmentary elevation view with part cutaway showing the closure of FIG. 5 as it is being applied to a container.

FIG. 7 is a view similar to that of FIG. 6 but showing the closure of FIG. 5 as the cap is being removed from the container.

FIG. 8 is an enlarged fragmentary view showing a modification to a portion of the closure of FIG. 5.

FIG. 9 is an enlarged fragmentary view showing another modification to a portion of the closure of FIG. 5.

DESCRIPTION OF THE PREFERRED EMBODIMENT

Figure 1:
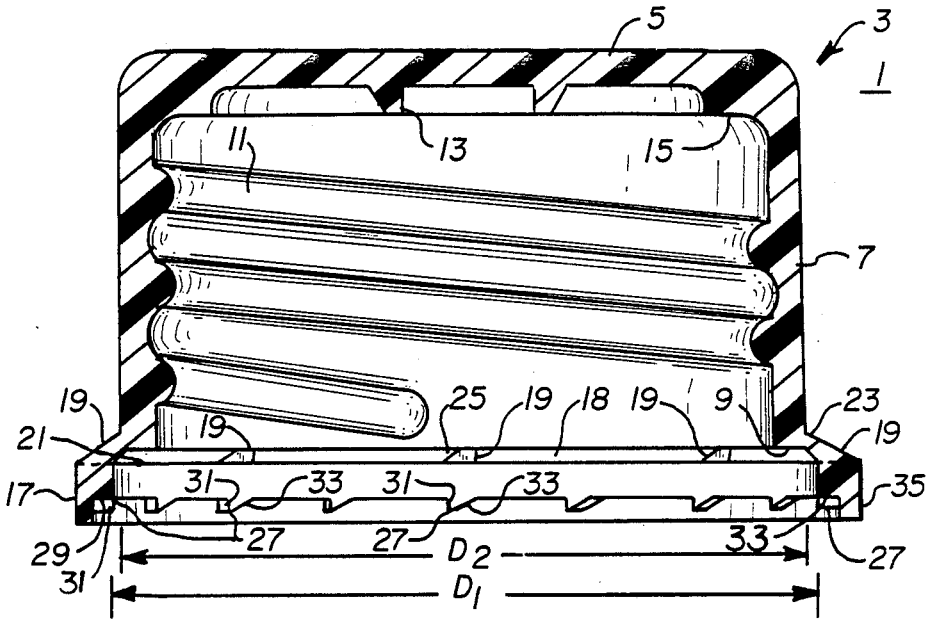
FIG. 1 is a vertical section through a closure in accordance with the invention.
Figure 2:
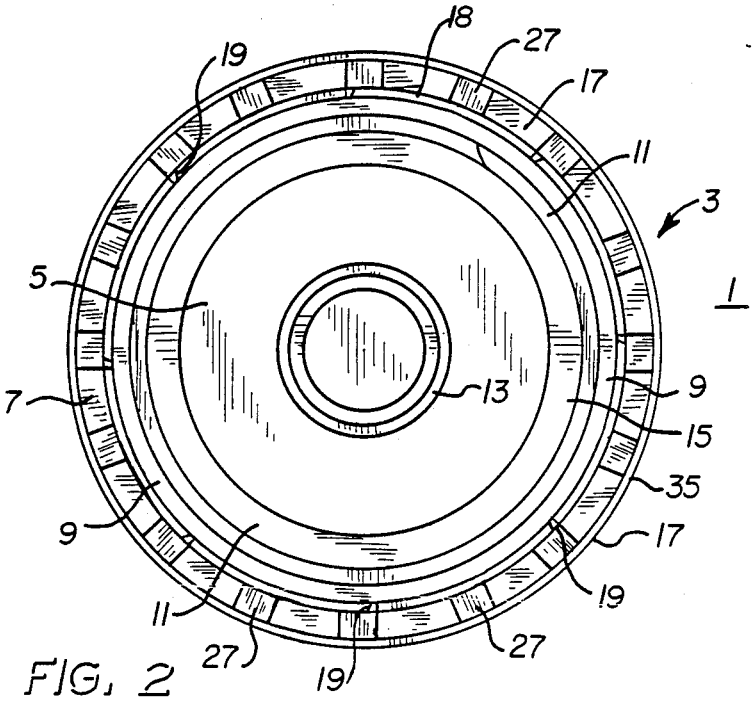
FIG. 2 is a bottom view of the closure of FIG. 1.

Referring to FIGS. 1 and 2, an exemplary closure 1 in accordance with the invention includes a cap 3 having an end wall 5 and a cylindrical skirt 7 depending from the end wall 5 and terminating in a free end 9. The skirt 7 is provided with internal threads 11. An annular bead 13 on the inner surface of the end wall 5 is coplanar with an annular shoulder 15 integrally formed at the intersection of the end wall 5 and skirt 7.

The closure 1 also includes an annular tamper band 17 having an inside diameter $D_1$ which is slightly larger than the outside diameter $D_2$ of the skirt 7 thereby forming an annular gap 18. A plurality of frangible bridges 19 (eight in the exemplary closure) equally spaced circumferentially around a first, upper axial end 21 of the tamper band 17 connect the tamper band to the free end 9 of the skirt 7 across the gap 18. The bridges 19 taper axially and radially inward to form an intersection 23 with the skirt 7 of reduced cross-sectional area. The bridges 19 also taper radially and circumferentially to form notches 25 facing the direction in which the cap is unscrewed to further reduce the area of the intersection 23 of the bridges 19 with the free end 9 of the skirt 7.

A plurality of equally spaced ratchet teeth 27 (sixteen in the example) project axially from an attachment on the second or lower axial end 29 of the tamper band 17. These wedge shaped ratchet teeth 27 form generally axially projecting engagement surfaces 31 which face the direction in which the cap 3 is turned for removal. These wedge shaped ratchet teeth 27 also define inclined camming surfaces 33 which face circumferentially in the opposite direction. The outer perimeter of the tamper band 17 extends axially to form a lip 35 which conceals the ratchet teeth 27.

The closure 1 is integrally molded of a suitable thermoplastic material, such as by way of example only, polypropylene, high density polyethylene, low density polyethylene, polyethylene terephthalate (PET) or polyvinyl chloride. Since the inner diameter $D_1$ of the tamper band 17 is slightly larger than the outer diameter $D_2$ of the skirt 7, the closure 1 can be molded in one piece without the need for slides. Thus, the closure 1 can be pulled straight from the mold which reduces the cost of the mold and simplifies the molding process.

Figure 3:
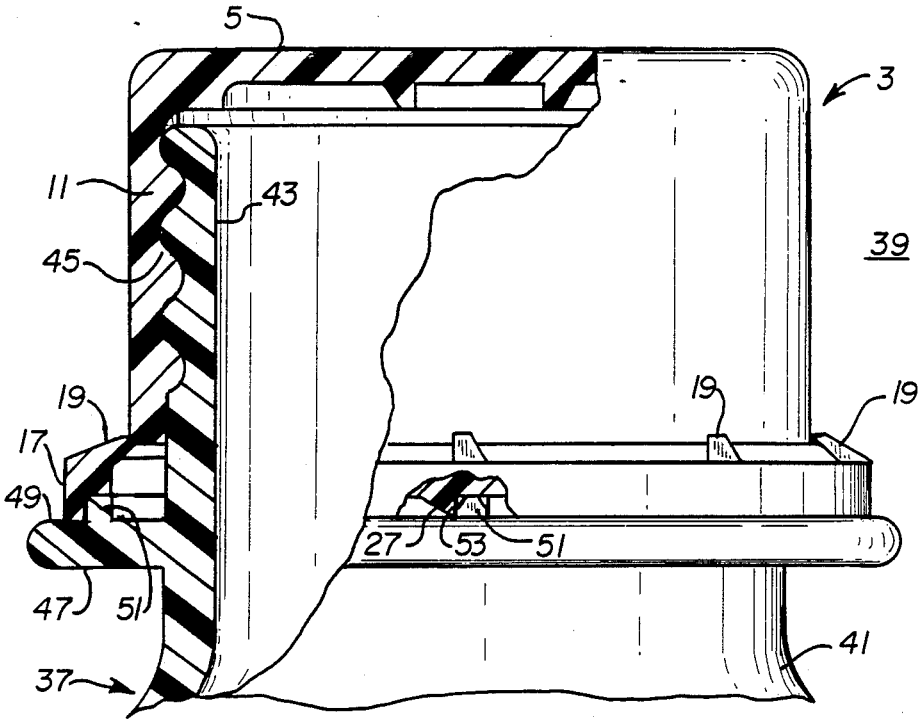
FIG. 3 is an elevation view partially in section and with part cut away showing the closure of FIGS. 1 and 2, in place on a container.
Figure 4:
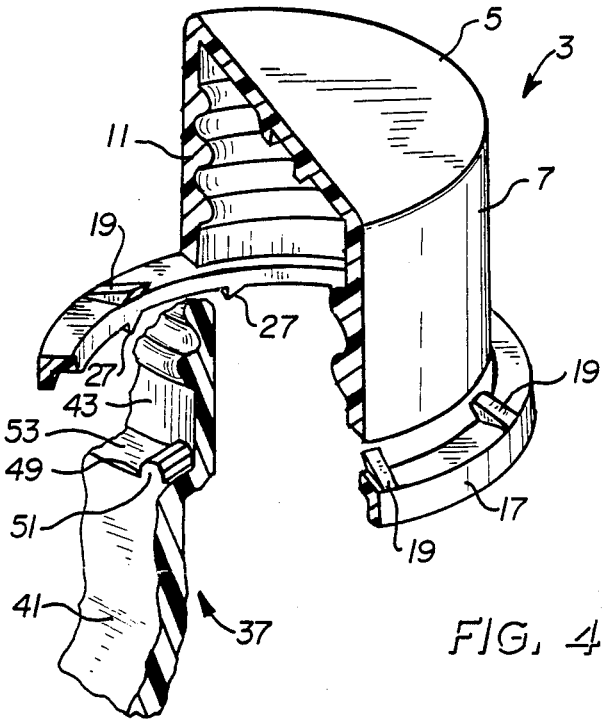
FIG. 4 is an isometric view partially in section and with part broken away illustrating the closure and container of FIG. 3 with the closure partially removed.

The closure is applied to a container 37 to form a closure system 39 as shown in FIGS. 3 and 4. The container 37 has a body portion 41 which tapers into a cylindrical neck 43 having external threads 45 complimentary to the threads 11 in the cap skirt 7. The container 37 in FIG. 3 is provided with a radially extending transfer bead 47 on the neck 43 below the threads 45. The transfer bead 47 defines a generally laterally extending surface 49 axially spaced from the threads 45. In the container 37 of FIG. 4, the neck 43 is stepped inward to form a shoulder which defines the laterally extending surface 49. Projecting axially from attachment points on laterally extending surface 49 and spaced quadrature on the surface 49 are four axially projecting lugs 51. The lugs 51 define generally axially extending engagement surfaces 53 which face opposite the direction in which the closure is rotated for removal. While four lugs 51 are used in the exemplary closure, other numbers of such lugs can be provided on the container.

In operation, the one piece closure 1 is screwed onto the neck 43 of the container 37 through the cooperation of threads 11 and 45 respectively. As the tamper band 17 approaches the transfer bead 47, the camming surfaces 33 contact the lugs 51 so that the ratchet teeth 27 ride up and over the lugs 51. The resiliency of the closure 1 and the hinge formed by the bridges 19 at the intersection 23 with the skirt 7 permit the tamper band 17 to deflect relative to the skirt 7 during ratcheting.

If the closure is turned in the opposite direction (counterclockwise as viewed in FIG. 4), the axially projecting engagement surfaces 31 on four of the ratchet teeth 27 on the tamper band 17 engage the axially projecting engagement surfaces 53 on the lugs 51 to block further rotation of the tamper band 17 with the cap 3. Continued application of force to remove the cap 3, creates a stress concentration at the notches 25 which shears the bridges 19 from the skirt 7 along the intersection 23 of reduced crosssection. This separates the tamper band 17 from the cap 3 which may then be completely removed from the container 37 or left loose on the container. Fracturing of the bridges provides a visual and mechanical indication that the closure has been removed or tampered with. The axial length of the engagement surfaces 31 and 53 on the ratchet teeth 27 and lugs 51, respectively, is sufficient that these surfaces remain axially aligned despite any axial separation of the tamper band 17 from the transfer bead 47 due to the helix angle on the threads 11 and 45 before the surfaces 31 and 53 come into engagement, and to preclude prying up of the tamper band 17. The large number of ratchet teeth 27 assures engagement of four teeth with the lugs 51 with very little rotation of the cap 3.

An alternative embodiment of a closure in accordance with the invention is shown in FIG. 5 where like parts to those of the closure of FIG. 1 are identified by like reference characters. The difference in this embodiment of the invention is that the cooperating ratchet member on the tamper band is a plurality of elongated projections 55 projecting axially from the lower axial end 29 of the annular tamper band 17.

As shown in FIG. 6, when the closure of FIG. 5 is screwed onto a container 37 (in the direction shown by the arrow in FIG. 6), the projections 55 contact the lugs 51 on the generally laterally extending surface 49 formed by the transfer bead 47 and are bent in a circumferential direction opposite to the direction of cap rotation. The length, 1, (see FIG. 5) of the projections 55 is greater than the axial distance, h, between the lower axial end 29 of the tamper band 17 and the generally laterally extending surface 49 on the container when the cap 3 is fully screwed onto the containers. With this configuration, when the cap is unscrewed (in the direction of the arrow in FIG. 7), the projections 55 become wedged at the intersection between the lugs 51 and the generally lateral surface 49. This places the projections 55 in compression. The strength of the projections 55 in compression is sufficient to prevent rotation of the tamper band 17 with the cap 3 resulting in shearing of the frangible bridges 19 and separation of the tamper band 17 from the cap 3.

This embodiment of the invention can also be easily molded since the projections 55 project axially and hence do not present any undercuts which would require slides in the mold. It would also be more difficult to defeat than the closure of FIG. 1 since each of the projections 55 would have to be pried up separately but simultaneously. As in the closure of FIG. 1, the projections 55 are concealed and protected by the annular lip 35 extending axially around the perimeter of the tamper band 17.

A modification of the axial projections 55 is shown in FIG. 8. Grooves 57 on either side of the projection 55' at the intersection with the tamper band 17 provide a hinge connection 59. This permits the projection 55' to be made stiffer, i.e. greater in cross-section so that the compression force can be taken longitudinally yet allows the projection to bend at the hinge connection.

Still another modification is shown in FIG. 9 where the projection is formed to project circumferentially as well as axially. This forms a camming surface 63 which can cam over the lugs 51 as the closure is applied to a container. This projection 61 will also bend as it cams over the lugs 51. When the cap is unscrewed, the projection 61 becomes wedged as described in connection with the projection 55. This form of the invention requires a slide in the mold or molding of the projection axially as in the embodiment of FIG. 5 or a post molding operation to produce the rake.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A closure system comprising:

a container having a neck portion with external threads thereon, and a generally laterally extending surface axially spaced from said external threads; and a closure comprising:

a cap having an end wall and an annular skirt extending axially from said end wall and terminating in an annular free end, said skirt having internal threads complimentary to the external threads on the container neck for selectively screwing said closure onto said container neck;

an annular tamper band having first and second axially displaced ends; and frangible bridge members detachably securing the first end of said tamper band to the free end of said skirt;

said closure system further including cooperating ratchet members projecting axially toward one another from attachment points on said second end of the tamper band and on the generally laterally extending surface of the container, said ratchet members defining substantially axially projecting engagement surfaces which when engaged prevent rotation of the tamper band with the skirt as the closure is rotated to unscrew the closure from the container neck thereby fracturing the frangible bridges and separating the tamper band from the skirt, said engagement surfaces being dimensioned to remain axially aligned for engagement throughout any initial axial movement of the tamper band with the skirts as the closure is unscrewed prior to fracture of said bridges.

2. The closure system of claim 1 wherein said annular tamper band has an annular lip extending axially along its outer perimeter concealing said cooperating ratchet member on said second end of said tamper band.

3. The closure system of claim 1 wherein at least one of said cooperating ratchet members comprises a plurality of circumferentially spaced wedge shaped ratchet teeth each defining a substantially axially projecting engagement surface and an axially and circumferentially projecting camming surface over which the other cooperating ratchet member rides as said closure is screwed onto the container.

4. The closure system of claim 3 wherein said at least one cooperating ratchet member comprising said plurality of ratchet teeth is on said second end of said tamper band and wherein the other cooperating ratchet member on said container comprises a number of circumferentially spaced axially projecting lugs each defining a said substantially axially projecting engagement surface.

5. The closure system of claim 4 wherein said annular tamper band has an inner diameter greater than the outer diameter of said skirt and wherein said frangible bridges taper axially and radially inward from the tamper band to the free end of the skirt to provide an area of smallest cross-section at an intersection with the skirt along which intersection said bridges fracture when the cap is unscrewed.

6. The closure system of claim 5 wherein said bridges are notched in the direction of rotation for removal of said cap from the container.

7. The closure system of claim 1 wherein one of said cooperating ratchet members comprises a plurality of axially projecting projections which are bent in a circumferential direction through contact with the other cooperating ratchet member as the cap is screwed onto the container, said projections having a length greater than the axial spacing between the second end of the annular tamper band and said generally laterally extending surface on said container when said closure is substantially fully screwed onto said container to place said projections in compression as the cap is unscrewed and prevent rotation of said annular tamper band with rotation of said cap, whereby the frangible bridges are fractured to separate the annular tamper band from the cap as the cap is unscrewed.

8. The closure system of claim 7 wherein said annular tamper band has an annular lip extending axially along its outer perimeter concealing said cooperating ratchet members with the cap substantially fully screwed onto said container.

9. The closure system of claim 7 wherein said axially projecting projections comprising said one cooperating ratchet member are on said second end of said annular tamper band and wherein the other cooperating ratchet member comprises a number of lugs on said generally laterally extending surface on said container.

10. The closure system of claim 9 wherein said annular tamper band has an inner diameter greater than the outer diameter of said skirt to form an annular gap therebetween and wherein said frangible bridges extend across said gap from the said annular tamper band to said skirt.

11. The closure system of claim 10 wherein said bridges taper axially and radially inward to define an area of smallest cross section at an intersection with the skirt along which intersection said frangible bridges fracture when the cap is unscrewed.

12. The closure system of claim 11 wherein said frangible bridges are notched in the direction of rotation for removal of said cap from the container.

13. The closure system of claim 1 wherein one of said cooperating ratchet members comprises a plurality of elongated projections and the other cooperating ratchet member comprises a number of lugs, said elongated projections projecting axially and circumferentially in a direction forming a camming surface which cams over said lugs as said cap is screwed onto said container, at least some of said projections being placed in compression by said lugs as the cap is unscrewed preventing rotation of said annular tamper band with said cap, whereby said frangible bridge members are fractured to separate the annular tamper band from said cap.

14. The closure system of claim 13 wherein said elongated projections project axially and circumferentially from the second end of said tamper band, and said lugs extend axially from said generally laterally extending surface on said container.

15. The closure system of claim 14 wherein said elongated projections are molded to project axially from the second end of said annular tamper band and are bent circumferentially by said lugs on said generally laterally extending surface on said container as said cap is screwed onto said container.

16. A closure for selectively closing a container having a neck with external threads and lugs projecting axially from attachment points on a generally laterally extending surface axially spaced from said threads, said closure comprising:

a cap having an end wall and an annular skirt extending axially from said end wall and terminating in an annular free end, said skirt having internal threads complimentary to the external threads on the container neck for selectively screwing said closure onto said container neck;

an annular tamper band having first and second axially displaced ends, said first end being spaced from the free end of said cap skirt, and with a plurality of circumferentially spaced wedge shaped ratchet teeth projecting axially from attachment points on the second end of said tamper band; and a plurality of frangible bridges detachably securing the first end of said tamper band to the free end of the skirt with said tamper band extending axially beyond the free end of the skirt;

said ratchet teeth on the second end of the tamper band and said lugs on said generally laterally extending surface on the container defining substantially axially extending engagement surfaces which when engaged prevent rotation of the tamper band with the skirt as the closure is rotated to unscrew the closure from the container neck thereby fracturing the frangible bridges and separating the tamper band from the skirt, said ratchet teeth also defining camming surfaces over which the lugs on the container ride as said closure is screwed onto the container.

17. The closure of claim 16 wherein said annular tamper band has an inner diameter greater than the outer diameter of said skirt, and wherein said frangible bridges extend axially and radially inward from the tamper band to the free end of the skirt and define an area of smallest cross-section at an intersection with the skirt along which said bridges fracture when the cap is unscrewed.

18. The closure of claim 17 wherein said frangible bridges taper axially and radially inward to define said area of smallest cross-section at said intersection with the skirt.

19. The closure of claim 18 wherein said frangible bridges are notched in the direction of rotation for removal of said cap from the container to further reduce the crosssection at the intersection of the bridges with the skirt.

20. The closure of claim 19 wherein said annular tamper band has an annular lip extending axially along its outer perimeter to conceal said ratchet teeth.

21. A closure for selectively closing a container having a neck with external threads and lugs projecting axially from attachment points on a generally laterally extending surface axially spaced from said threads, said closure comprising:

a cap having an end wall and an annular skirt extending axially from said end wall and terminating in an annular free end, said skirt having internal threads complimentary to the external threads on the container neck for selectively screwing said closure onto said container neck;

an annular tamper band having first and second axially displaced ends said first end being spaced from the free end of said cap skirt, and a plurality of circumferentially spaced elongated projections projecting axially from attachment points on the second end of said tamper band; and a plurality of frangible bridges detachably securing the first end of said annular tamper band to the free end of the skirt with said annular tamper band extending axially beyond the free end of the skirt;

said projections having a length greater than the axial spacing between the second end of the annular tamper band and said generally laterally extending surface on said container when said closure is substantially fully screwed onto said container to wedge said projections between said lugs and said generally laterally extending surface on said container and place said projections in compression as the cap is unscrewed to prevent rotation of said annular tamper band with rotation of said cap, whereby the frangible bridges are fractured to separate the annular tamper band from said cap as said cap is unscrewed.

22. The closure of claim 21 wherein said annular tamper band has an annular lip extending axially along an outer perimeter to conceal said elongated projections and said lugs with said closure substantially fully screwed onto said container.

23. The closure of claim 22 wherein the annular tamper band has an inside diameter greater than the outside diameter of the skirt and wherein said frangible bridges extend axially and radially inward from said tamper band to said free end of the skirt and define an area of smallest cross section at an intersection with the skirt along which said bridges fracture when the cap is unscrewed.

24. The closure of claim 23 wherein said frangible bridges taper axially and radially inward to define said area of smallest cross section at said intersection with the skirt.

25. The closure of claim 24 wherein said frangible bridges are notched in the direction of rotation for removal of said cap from the container to further reduce the cross section at the intersection of the frangible bridges of said skirt.

* * * * *